US005894699A

United States Patent [19]

Fulton et al.

[11] Patent Number: 5,894,699

[45] Date of Patent: Apr. 20, 1999

[54] CRYPT CONSTRUCTION

[76] Inventors: Robert H. Fulton, 8605 Sunbury Place, Delta, British Columbia, Canada, V4C 3Y9; Carmine De Simone, # 18, 2590 Panorama Drive, Coquitlam, British Columbia, Canada, V3E 2W9; Michele Sorrenti, 1775 Windermere Street, Vancouver, British Columbia, Canada, V6M 3R1

[21] Appl. No.: 08/914,304

[22] Filed: Aug. 18, 1997

[51] Int. Cl.[6] ..... E04H 13/00

[52] U.S. Cl. ..... 52/132; 52/128; 52/131; 52/134; 52/137

[58] Field of Search ..... 52/131, 132, 134, 52/136, 137

[56] References Cited

U.S. PATENT DOCUMENTS

| | | | |
|---|---|---|---|
| 912,368 | 2/1909 | Downey . | |
| 1,300,173 | 4/1919 | Kennedy . | |
| 2,618,145 | 11/1952 | Sinner et al. . | |
| 3,213,576 | 10/1965 | Davies . | |
| 3,233,374 | 1/1963 | Micheels et al. . | |
| 3,248,828 | 5/1966 | Shackelford . | |
| 3,567,039 | 3/1971 | Evans . | |
| 3,754,805 | 8/1973 | Pangburn et al. . | |
| 3,778,942 | 12/1973 | Bondi . | |
| 3,906,308 | 9/1975 | Amason et al. . | |
| 3,938,287 | 2/1976 | Gauchard . | |
| 4,073,100 | 2/1978 | DiGiovanni, Jr. . | |
| 4,523,413 | 6/1985 | Koppenberg . | |
| 4,614,066 | 9/1986 | Koppenberg . | |
| 4,648,219 | 3/1987 | Johnston, Sr. | 52/131 |
| 4,669,157 | 6/1987 | Schwarten . | |
| 4,727,632 | 3/1988 | Yearsley . | |
| 4,862,655 | 9/1989 | LePage et al. | 52/131 X |
| 4,928,447 | 5/1990 | Stoecklein | 52/136 |
| 5,010,697 | 4/1991 | Schwarten | 52/136 X |
| 5,115,607 | 5/1992 | Pirozzoli et al. . | |
| 5,157,817 | 10/1992 | Davidian . | |
| 5,195,812 | 3/1993 | Eickhof . | |
| 5,201,980 | 4/1993 | Chandler et al. . | |
| 5,217,622 | 6/1993 | Flores | 52/132 X |
| 5,408,787 | 4/1995 | Barnett | 52/132 X |
| 5,511,345 | 4/1996 | Jones et al. | 52/136 |

*Primary Examiner*—Christopher Kent
*Assistant Examiner*—Yvonne Horton-Richardson
*Attorney, Agent, or Firm*—Christie, Parker & Hale, LLP

[57] ABSTRACT

A crypt system comprising a front frame, a rear frame and a plurality of cells received between the front and rear frames, inclined longitudinally to form a column of cells. Drain and ventilation headers communicate with each cell and an attachment system for joining adjacent columns to each other is provided. The front frame comprises horizontal and vertical members that are spaced to be a close fit on the cells. Each cell is independently sealable by a sealing panel that is attached over the open front end of the cell. A plurality of discrete facing panels are mountable to the front frame of the crypt by way of rectangular section posts extending outwardly from the vertical members at predetermined intervals to abut angled corners of the facing panels and retaining members that hold the angled corners of the facing panels. The structure of the present invention provides a crypt structure that does not suffer from the maintenance problems of existing mausoleums. Resealing of facing plates can be efficiently and reliably accomplished as required. Removal of a facing panel from a cell is easy for inspection, repair or casket loading purposes. Furthermore, the retaining system for the facing panels of the present invention accommodates settling, building shrinkage or seismic disturbance of the surrounding mausoleum structure.

17 Claims, 9 Drawing Sheets

CRYPT CONSTRUCTION

BACKGROUND OF THE INVENTION

The conventional way to construct crypts is using cast-in-place concrete with an egg crate style formwork. This produces a series of rows and columns of cells, known as a crypt bank, built integrally with the mausoleum.

There are a number of problems with this type of construction. First, cracking of the concrete takes place due to shrinkage. Furthermore, the mausoleum building tends to settle around the concrete, egg crate construction. This leads to leakage of both fluid and gases from the crypt enclosure. This is, of course, unacceptable.

It is also important to maintain precise alignment on the front face of the crypt bank in order to ensure proper sealing and an aesthetic visual appearance. This is very difficult, if not impossible, to do with cast in place concrete which shrinks and settles over time as mentioned above. Also, during seismic activity joints can be easily skewed resulting in leakage and unsightly geometric lines.

A further problem with the conventional construction is in accurately placing and holding the facing on the crypts. Typically the facing will be marble slabs. Settlement and shrinkage causes marble facing panels to loosen. This is unsightly and also produces leaks around the front face seal. This is also unacceptable.

As a result of these disadvantages in the prior art, there is a substantial cost from constant maintenance required to maintain not only the sealing of the crypts but also in resealing the facing gaskets around the front of the crypt and in constantly adjusting the loose facing panels at the front of the crypts. The resealing of the crypts is particularly difficult. It must be done by removing the contents and attempting to grout the cracks. Retaining and positioning the facing marble panels by a single worker is difficult. At times, while installing or adjusting a single facing marble panel, the other adjacent panels can be loosened and seals disturbed.

SUMMARY OF THE INVENTION

The present invention seeks to address these problems in the prior art.

Accordingly, in its broadest aspect, the present invention is a crypt comprising:

a front frame;

a rear frame;

a plurality of cells having an open front end, the cell being received between said front and rear frames and being inclined longitudinally to form at least one column of stacked cells; and a drain and ventilation header communicating with each cell.

The crypt preferably includes a lower combination drain/vent header communicating with each cell via a single port only at the bottom of the crypt for both venting and draining, that joins with a substantially vertical riser that interconnects the drain/vent headers. A negative pressure is applied to each cell through this system to ensure that all gases are removed and there is no leakage through the front face of the crypt.

Typically, the crypt will be mounted on a base and there are partition walls defining the sides of the crypt or dividing the crypt into a number of compartments.

In a preferred embodiment, each cell is formed of a foam plastic having a reinforced plastic skin, for example, of a resin reinforced with glass fiber.

In one preferred embodiment, the front frame comprises horizontal and vertical members. The vertical members are spaced to be a close fit on the cells. The front frame desirably includes means to attach a plurality of discrete facing panels to the crypt, for example, facing panels of marble, known in the art.

In a preferred embodiment, this means of attaching the facing panels comprise a plurality of rectangular section posts extending outwardly from the vertical members. They are arranged at predetermined intervals. The flat faces of the rectangular section post abut angled corners of facing panels formed by removing the corners of the facing panels to provide an abutment surface. There are retaining members attached to the post to retain the facing panels.

In a preferred embodiment, the posts have a threaded recess with plastic insert and there is a threaded column associated with the retaining member to engage a threaded recess. By this means, a retaining panel may be clamped between the front frame and a plurality of retaining members, typically one at each corner. The plastic insert prevents free rotation of the retaining panel.

The retaining member may be a disc having a portion of its periphery removed. By this means the disc may be rotated between a position where it retains four facing panels to a position where it retains three facing panels. In this last position, the fourth facing panel can be removed by ensuring that all the retaining members are rotated to a position so that the four corners of the facing panel to be removed are free.

BRIEF DESCRIPTION OF THE DRAWINGS

Aspects of the present invention are illustrated, merely by way of example, in the accompanying drawings in which.

Figure 9:
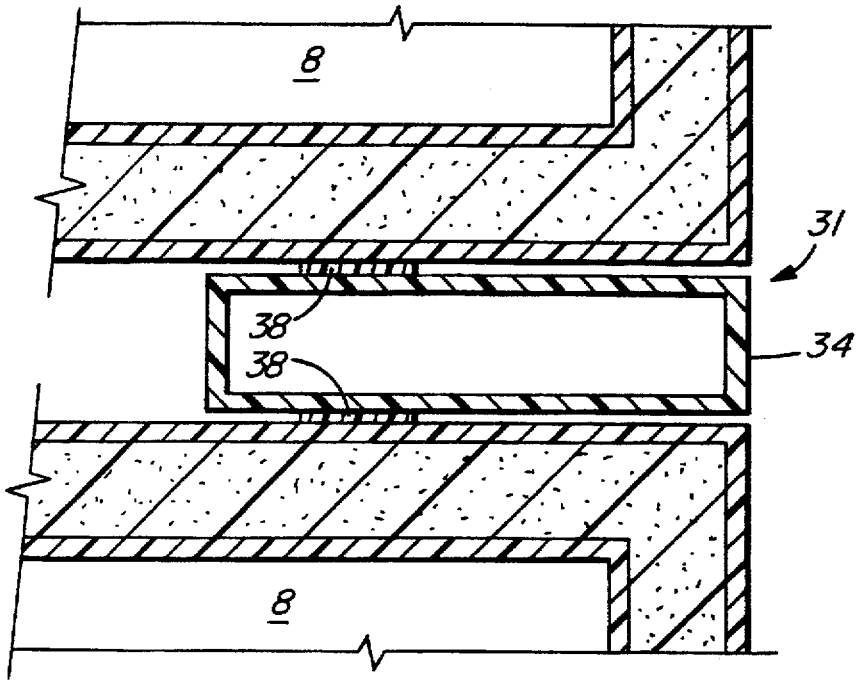
Figure 11:
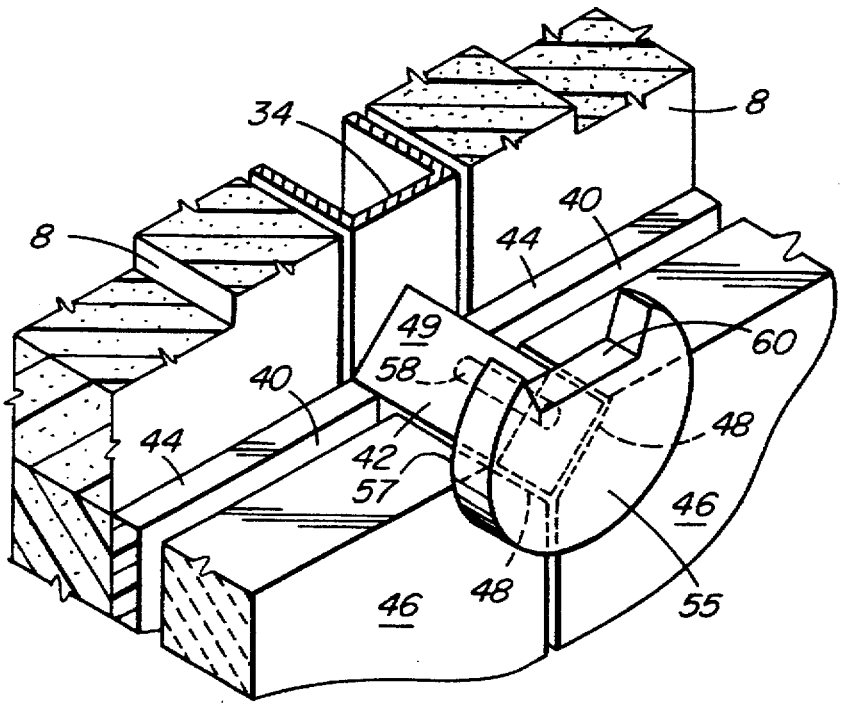

FIG. **8*a*** is a detailed section view showing the moulded fitting that attaches to the front end of a cell;

FIG. 9 is a detailed section view through the rear frame;

FIG. **10*a*** is a detailed view illustrating the retaining member useful in the present invention rotated to a position to release an upper corner of a facing panel;

FIG. **10*b* is a detailed view illustrating the retaining member rotated to a position to permit release of a lower corner of a facing panel; and FIG. 11** is a perspective view showing the retaining member rotated to a position to retain four adjacent facing panels.

DETAILED DESCRIPTION

Figure 5:
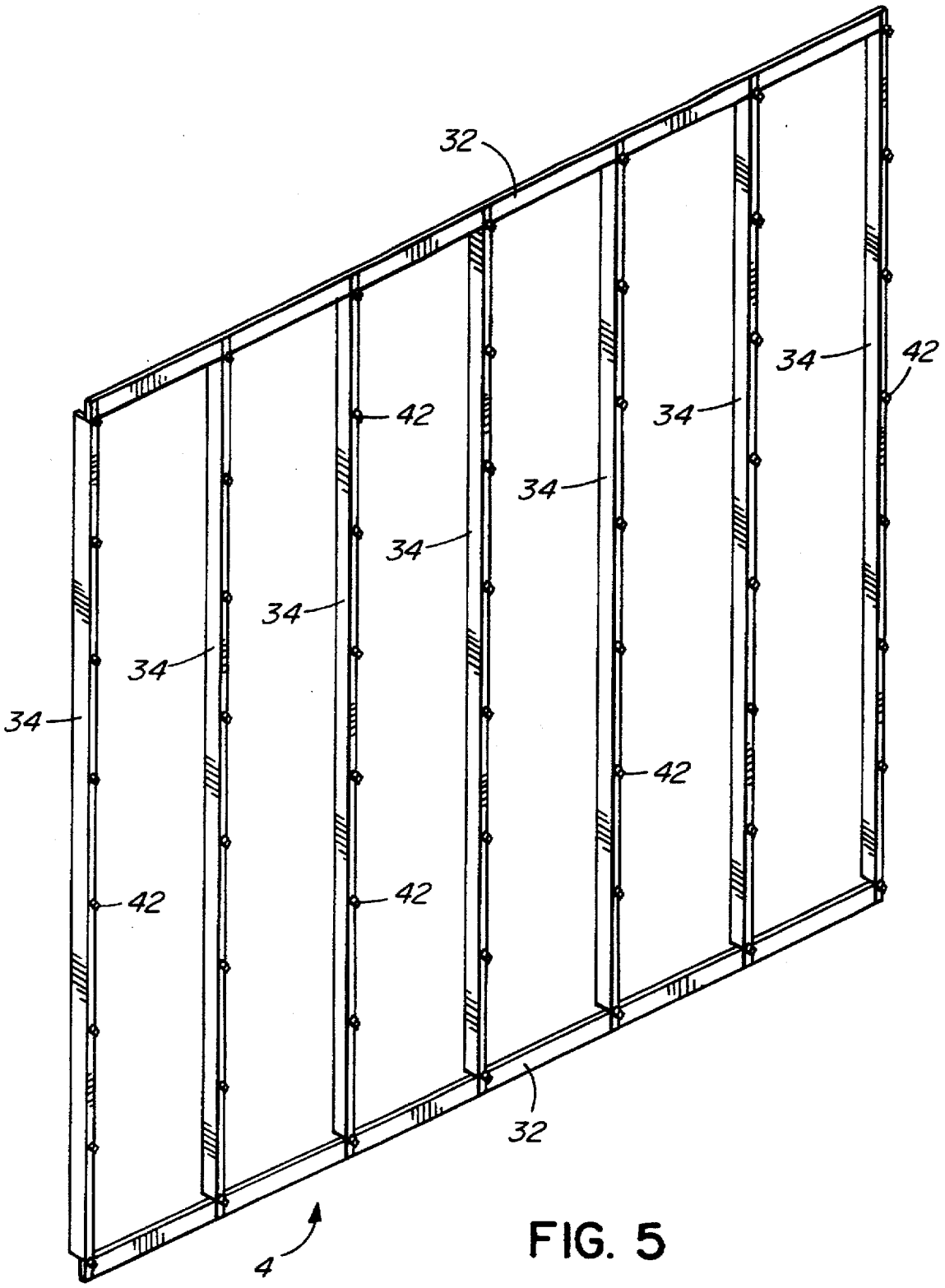
FIG. 5 is a view of the front frame of the crypt structure of the present invention.
Figure 6:
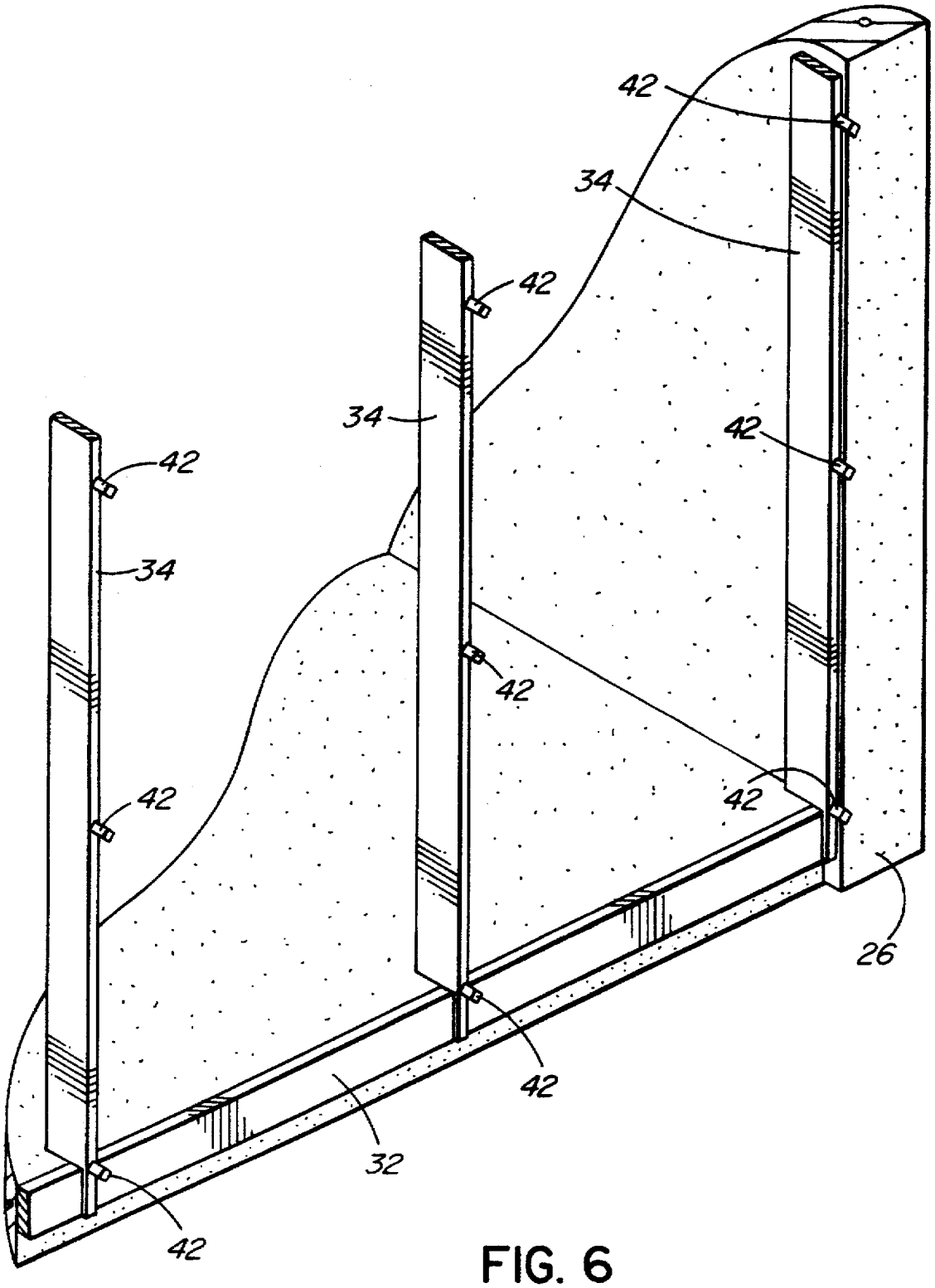
FIG. 6 is a detailed view of the front frame.

The Figures show a crypt structure 2 comprising a front frame 4, shown in greater detail in FIGS. 5 and 6, and a rear frame 6. A plurality of cells 8 extend longitudinally between the front and rear frames as shown in FIG. 2. Cells 8 are stacked on top of each other to form a column 10 of cells as shown particularly in FIGS. 1 and 2.

There is a combination drain/ventilation system communicating with each cell. The system comprises a port 12 formed in a lower corner of each cell 8 that communicates with a vertical riser pipe 14 associated with each column of cells adjacent rear frame 6 as best shown in FIGS. 2 and 3. Preferably, port 12 is a pipe of approximately one inch diameter and riser pipe 14 is a four inch diameter pipe. The floor 13 of each cell 8 is inclined slightly downwardly to the rear of the cell to permit fluids to drain easily to port 12.

Figure 1:
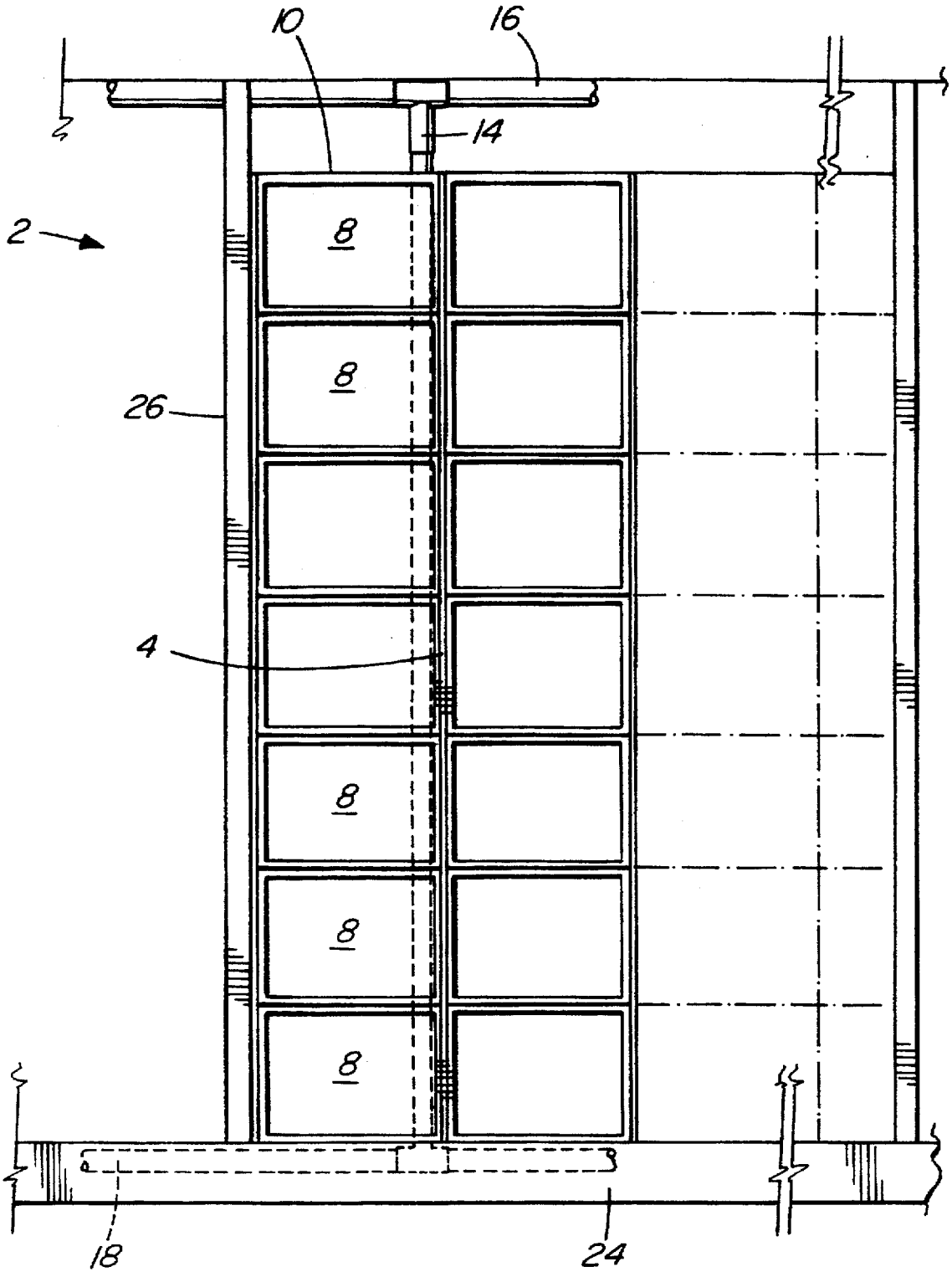
FIG. 1 is a front elevation view of a crypt constructed according to the present invention.
Figure 2:
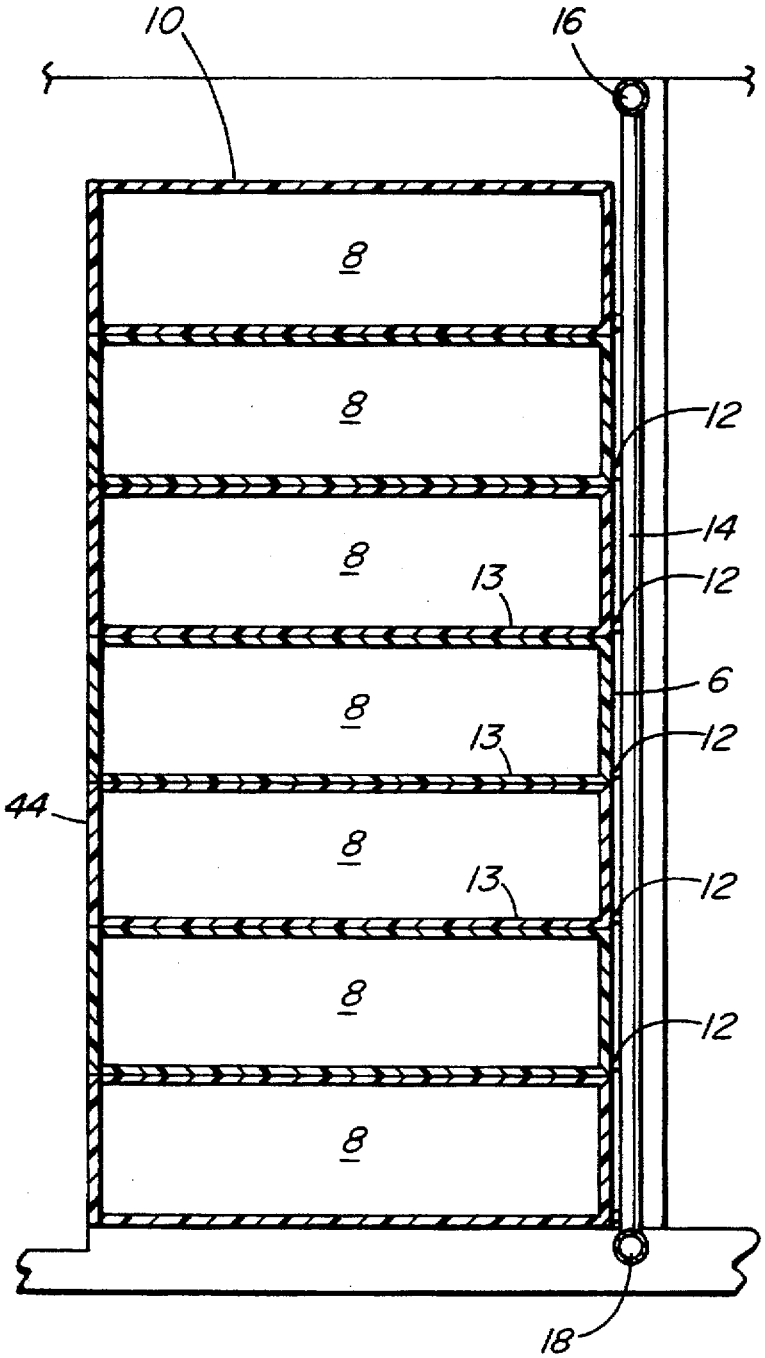
FIG. 2 is a side elevation of the crypt of FIG. 1.
Figure 3:
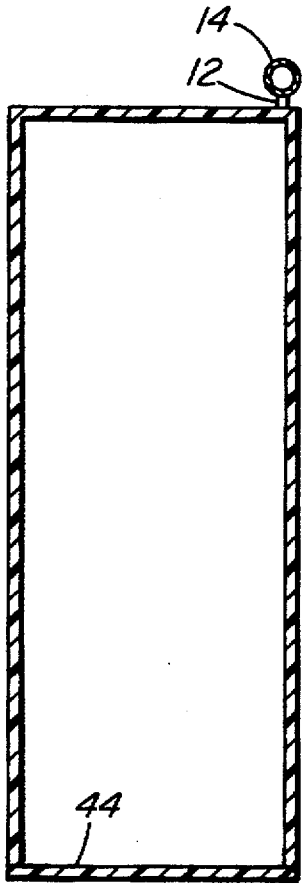
FIG. 3 is a partial plan of an individual crypt cell.

Referring to FIGS. 1 and 2, vertical riser pipe 14 defines a drain and ventilation header that joins to an upper generally horizontal vent pipe 16 that is connected to a ventilation exhaust system (not shown). The ventilation exhaust system applies a negative pressure to each crypt to ensure that all gases are removed from the rear at port 12 and that there is no leakage of gases through the front of each cell.

Vertical riser pipe 14 also connects to a lower generally horizontal drain pipe 18 that is connected to a drain system (not shown). Port 12, vertical riser pipe 14 and drain pipe 18 co-operate to allow the escape of any liquids from each cell 8.

Figure 4:
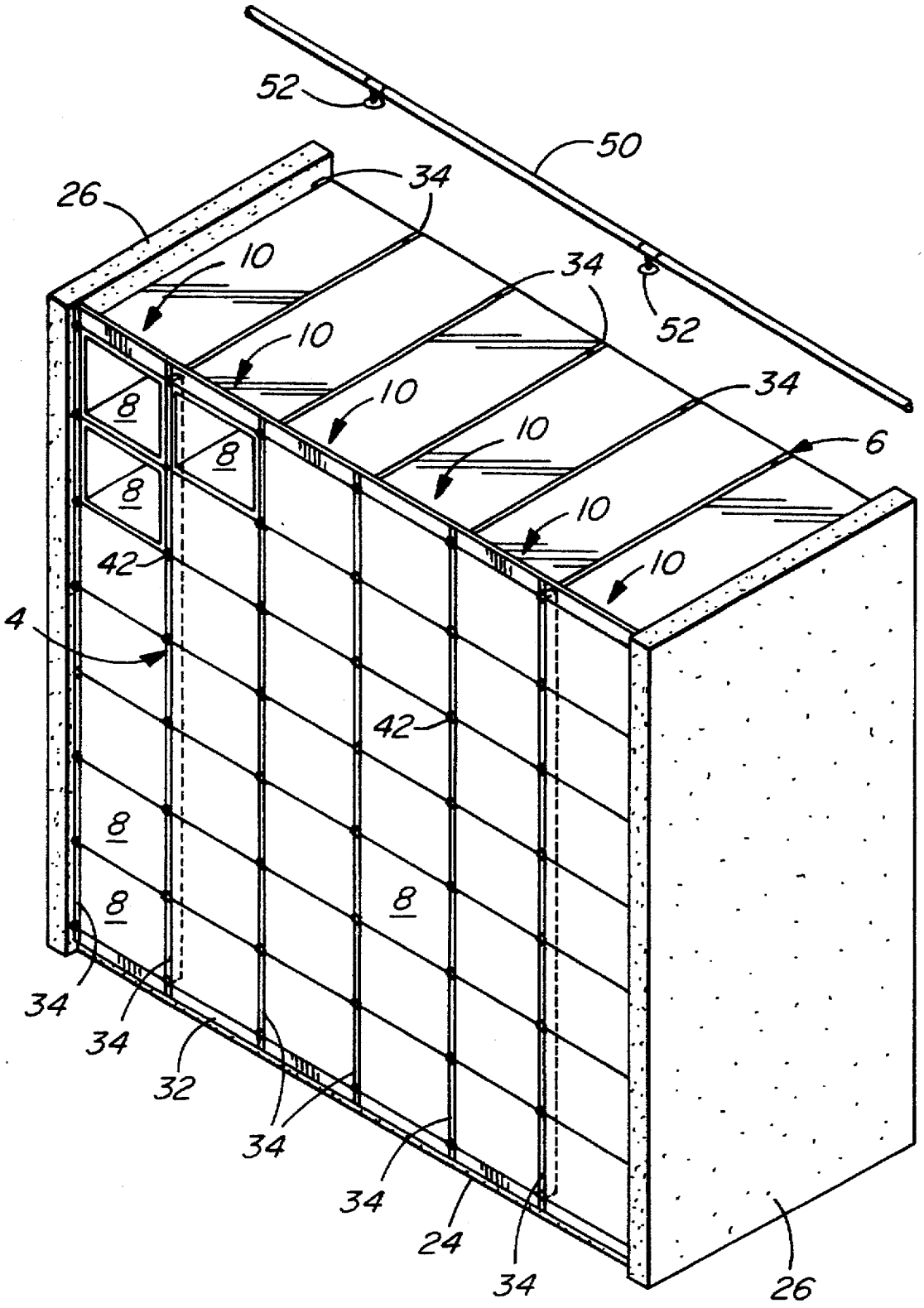
FIG. 4 is a perspective view of an assembled crypt structure according to the present invention.

FIG. 4 illustrates an assembled array of cells 8 that are stacked on top of base 24 and anchored between partition walls 26 by front frame 4 and rear frame 6 to define a bank of crypt cells.

Figure 7:
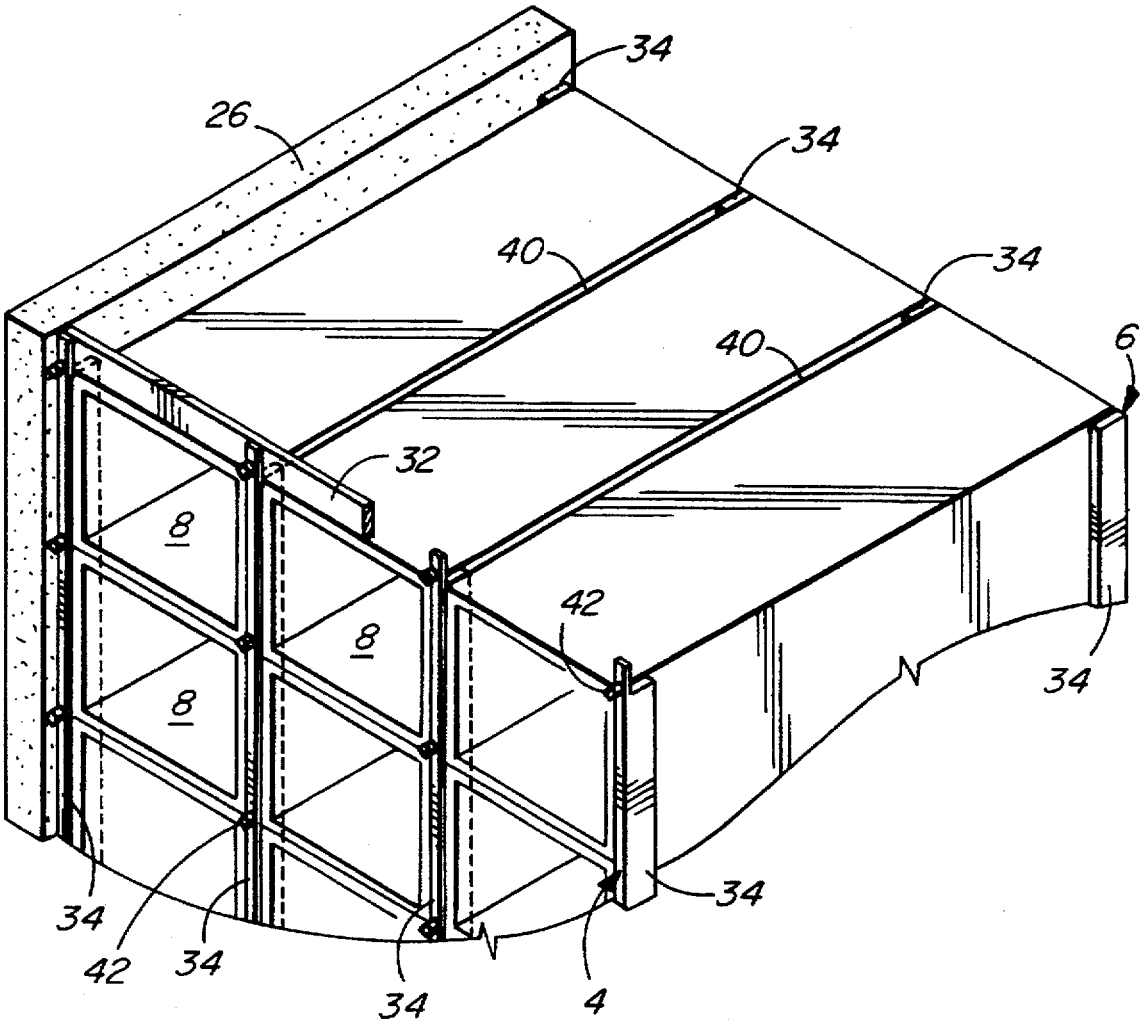
FIG. 7 is a detailed view illustrating the front and rear frames of the crypt structure of the present invention.

Each cell 8 is formed from a foam plastic having a reinforced plastic skin. Moulding is such that these cells can be formed with great precision to very low tolerances. As shown particularly in FIG. 5 and FIG. 6, front frame 4 comprises upper and lower horizontal members 32 that are joined by a series of vertical members 34. Vertical members 34 are spaced to be a close fit on cells 8 and act to locate the cells so that they form a column 10 with precision. FIG. 6, in particular, shows that vertical members 34 and horizontal members 32 are arranged at right angles to each other. Rear frame 6, shown partially in FIG. 7, is similar in structure to front frame 30 but is positioned adjacent the rear end of the cells. Rear frame 6 is formed from vertical members 34 only. Vertical members 34 of the front and rear frames extend into the region of the cells to provide a surface for bonding of the cells to the frames.

Figure 8:
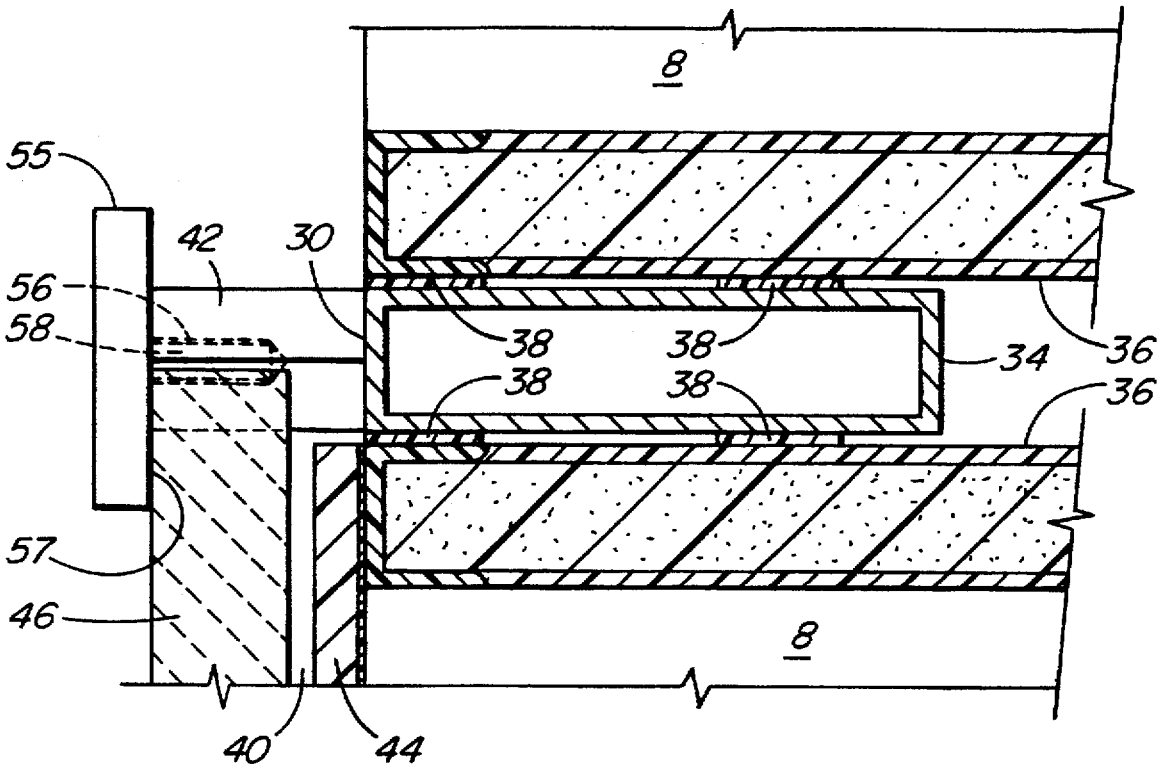
FIG. 8 is a detailed section view through the front frame.
Figure 8A:
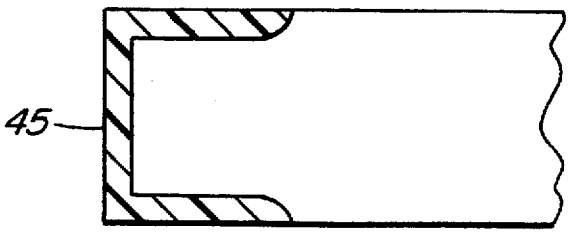

FIG. 8 is a detailed section view looking down a vertical member 34 of front frame 4. The outer surfaces 36 of the plastic moulded side walls of cells 8 on either side of vertical member 34 are bonded at 38 to the vertical member by suitable adhesive. An example of a suitable adhesive is sold under the trademark 3M Window Weld Primeless, Superfast Urethane (3M Part No. 08609). FIG. 9 is a similar view to FIG. 8 showing the similar manner in which the rear end of each cell 8 is bonded at 38 to vertical member 34 of rear frame 6. Preferably, front frame 4 is made from steel for strength while rear frame 6 is formed from fibre reinforced plastic.

As shown particularly in FIG. 6, front frame 4 includes means to attach a plurality of discrete facing panels to the crypt. These means comprise rectangular section posts 42 extending outwardly from the vertical members at predetermined intervals, in general are determined by the size of a cell 8 and, therefore the size of a sealing panel 44 and the facing panel 46 to be used with the cell.

Sealing panel 44 and facing panel 46 are best shown in FIG. 8. Preferably, sealing panel 44 is a fibre reinforce panel that is bonded at 48 to a moulded fitting 45 installed about the front opening of the cell. Moulded fitting 45 allows sealing panel 44 to fit precisely within front frame 4 to cover cell 8 and create a sealed cell after a casket has been inserted into the cell. Adjustment of vertical members 34 is possible to ensure a proper seal. Bonding compound can also be used to fill any minor gaps between the front frame 4, the cell 8 and sealing panel 44.

Once sealing panel 44 is in place, an outer facing panel 46 is installable on the rectangular section posts 42 that extend from vertical frame member 34. Facing panel 46 is preferably a marble panel. The use of a separate sealing panel 44 and a facing panel 46 permits adjustment of the facing panel to be done independently of the sealing of each cell 8.

By referring to FIGS. 7 and 8, it can be seen that there are preferably longitudinal gaps 40 between adjacent cells 8 and another gap 40 between sealing panel 44 and facing panel 46 at the front of each cell. These gaps are intentional to provide channels for the flow of water between cells from a sprinkler system. Such a sprinkler system is shown in FIG. 4 comprising a water supply line 50 and spaced sprinkler heads 52 above the crypt cells 8. In general, conventional crypt designs do not provide fire protection measures as they would require a separate sprinkler in each cell which is impractical.

FIGS. 8, 10*a*, 10*b* and 11 illustrate retaining members 55 that can be attached to post 42 to retain facing panels 46. As shown particularly in FIG. 10, the facing panels 46 have their corners 48 removed to provide a flat surface 49 that abuts on the flat surface 50 of the rectangular section post 42. As best shown in FIG. 8, each post 42 has an internal threaded recess 56, and there is a threaded fastener 58 extending from the rear face 57 of the retaining member 55 to engage the threaded recess. By this means, a retaining panel 46 may be retained between front frame 30 and the plurality of retaining members 55 with the cut-off corners 48 resting on the rectangular section post 42. This provides a retaining system of pleasing appearance, but its chief virtue is functional.

Figure 10A:
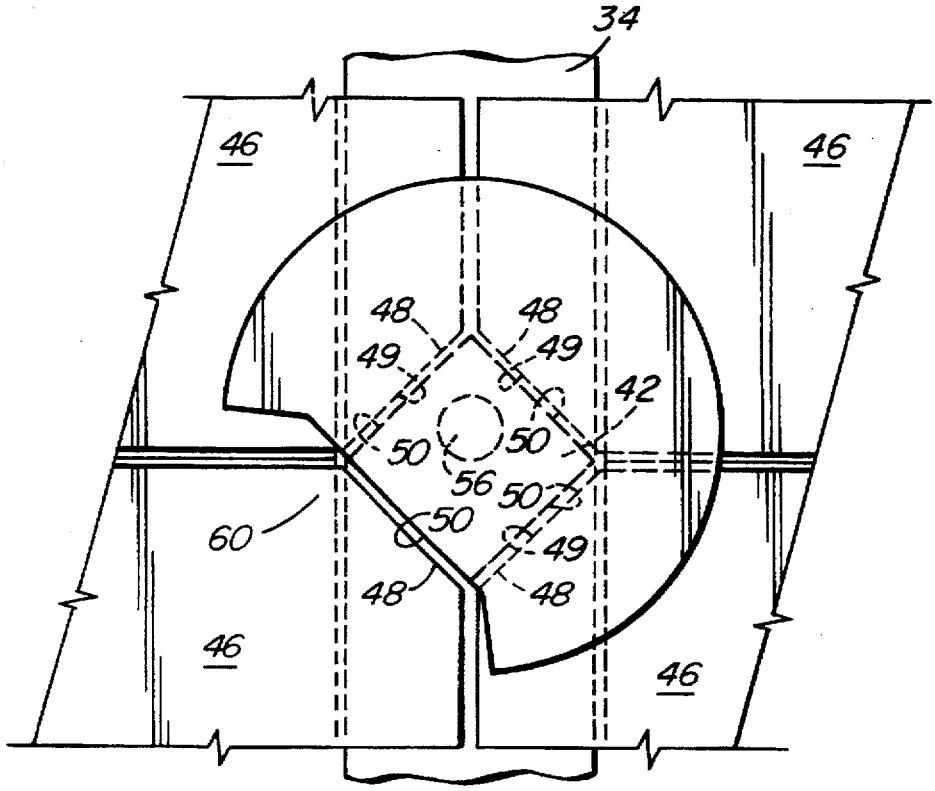
Figure 10B:
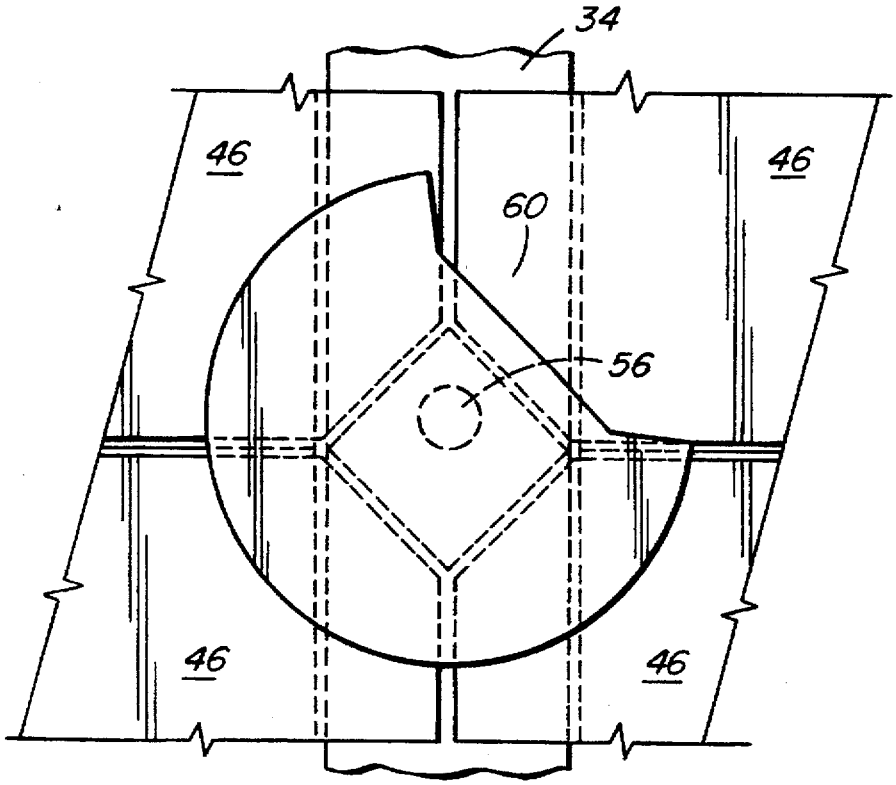

A retaining member is shown in detail in FIGS. 10*a*, 10*b* and 11. The retaining member 55 is preferably a disc having a portion 60 of its periphery removed. The disc may thus be rotated to a position where it is capable of retaining four facing panels 46, as shown in FIG. 11, by having all the panels abut an inner surface of the disc. Alternatively, the disc may be rotated to the position shown in FIG. 10*a* where the disc contacts three panels and the fourth panel may thus be removed. To do this it will, of course, be necessary to rotate all four discs that locate the corners of a particular facing panel 46, but this is easily done by rotating the discs about their threaded members 58.

As shown particularly in FIGS. 10*a* and 10*b*, the threaded recess 56 is preferably off-center to rectangular post 42. By this arrangement, the disc can be rotated to the position shown in FIG. 10*a* to fully uncover an upper corner of a panel 46 to be released, and to the position indicated in FIG. 10*b* to partially uncover the lower corner of a panel. Partially uncovering the lower corner of a panel allows the lower edges of the panel to be safely retained and supported on posts 42 to prevent slippage off the posts while the upper edge of the panel is being manoeuvred past the upper retaining discs.

The fastener 58 may be separate from the retaining member 55 and the retaining member would then have a clear opening to receive the fastener. Although not shown, the fastener 58 may be provided with a slot or the like to permit its rotation. A bolt may be used.

Alternatively, threaded recess 56 in post 42 can be equipped with a friction device such as a hollow plastic insert 60 (see dashed lines in FIG. 10) to receive threaded fastener 58 of retaining member 55. The plastic insert creates sufficient resistance to rotation of retaining member that the retaining member will tend to stay in the position to which it is rotated and will not pivot due to its own weight. This means that a worker can rotate retaining member 55 to a desired position, such as that shown in FIG. 10, at all four corners of a particular facing panel 46 to release the panel while retaining all adjacent panels in place.

Preferably, the exposed surface 62 of retaining member 55 will be a decorated front face of cast bronze or other suitable material.

The present invention thus provides a crypt having a number of marked advantages over the prior art. Because of the structure of the cells no shrinkage or leakage of fluid or gas takes place in the cells. Gases and fluids can easily be drained along the sloped bottom floor of each cell to the drain and ventilation port. Furthermore, the front and back frames are bonded to the crypt cells 8 during construction to ensure a strong, reliable overall structure that ensures accurate alignment at the face of the crypts and to permit precise positioning and excellent sealing of the sealing panels and the marble facing panels.

Because the invention allows the manufacturing of cells and frames from foam and reinforced plastic, the crypt structure of the present invention is lighter than conventional concrete crypts. This results in lower building costs, particularly lower foundation and handling costs. Moulding of the cells produces a smooth, friction free surface. This provides easier placement of a casket.

Because the cells are lightweight, the machinery necessary for incorporating them into the crypt is simple.

A particular advantage is the provision of the retaining disc which provide an excellent, secure location for the marble facing plates but also provide a means whereby these plates can be removed, should it be necessary. It is a disadvantage of the prior art that it can be difficult to pull out one of the marble panels without affecting the adjoining panels. Often the seal of the adjoining panels is broken when a central panel is removed. This is not so in the present invention.

It should also be noted that the rectangular section retaining posts bear the weight of two panels above. The vertical member system and the retaining disc system, allow the support of the panels above without loading the edges of the panels below. This again permits easy panel removal for either inspection, repair or casket loading.

Although the present invention has been described in some detail by way of example for purposes of clarity and understanding, it will be apparent that certain changes and modifications may be practised within the scope of the appended claims.

We claim:

1. A crypt comprising:

a front frame;

a rear frame;

a plurality of cells, each cell having a sealable open front end, a top, a bottom, and side walls, the bottom having an inclined floor, and the cells being arranged between said front and rear frames in a stacked configuration with the tops and bottoms of adjacent cells being in direct contact to form at least one self-supporting column of stacked cells;

a drain and ventilation header communicating with each cell;

a sealing panel mountable over the sealable open front end of each cell to seal each cell; and a plurality of facing panels removably installable adjacent each of the front ends of the cells by mounting to the front frame.

2. A crypt as claimed in claim 1 including a lower drain header and an upper vent header communicating with each cell via a port formed in the cell.

3. A crypt as claimed in claim 1 including a base and spaced, partition walls defining a pair of sides to the crypt, the space between the partition walls housing at least one column of stacked cells.

4. A crypt as claimed in claim 1 in which each cell is formed of a foamed plastic having a reinforced plastic skin.

5. A crypt as claimed in claim 1 in which each cell is bonded to the front and rear frames to position and cells with respect to each other.

6. A crypt as claimed in claim 1 including a moulded fitting for installation about the open front end of each cell to receive the sealing panel to ensure a reliable seal.

7. A crypt as claimed in claim 1 in which the front frame comprises horizontal and vertical members, the vertical members spaced to be a close fit on the cells.

8. A crypt as claimed in claim 7 in which the front frame includes means for attaching the plurality of discrete facing panels to the crypt.

9. A crypt as claimed in claim 8 in which the means to attach a plurality of discrete facing panels comprises a plurality of rectangular section posts extending outwardly from said vertical members at predetermined intervals to abut angled corners of said facing panels;

retaining members attached to said posts to retain the facing panels.

10. A crypt as claimed in claim 9 in which said posts have a threaded recess and there is a threaded fastener on said retaining member to engage the threaded recess, whereby a facing panel may be retained between said front frame and a plurality of retaining members.

11. A crypt as claimed in claim 10 in which each retaining member is a disc having a portion of its periphery removed whereby the disc may be rotated between a position where it retains four facing panels to a position where it retains three facing panels.

12. A crypt as claimed in claim 11 in which the threaded recess is off-center of said post.

13. A crypt as claimed in claim 10 in which said threaded fastener is separate from said retaining member, said retaining member having a clear opening to receive said threaded fastener.

14. A crypt as claimed in claim 13 including means on said threaded fastener to abut said retaining disc and means on said threaded fastener to rotate said fastener.

15. A crypt as claimed in claim 10 in which said threaded recess is provided with a friction insert to limit rotation of the threaded fastener of the retaining member such that the retaining member will tend to stay at the position to the retaining member is rotated.

16. A crypt as claimed in claim 14 in which the friction insert is a plastic insert.

17. A crypt as claimed in claim 1 including a sprinkler system to supply water and in which the adjacent columns of stacked cells are separated by a gap adapted to channel water between columns of cells.

* * * * *